US007660428B2

(12) United States Patent
Rodman et al.

(10) Patent No.: US 7,660,428 B2
(45) Date of Patent: Feb. 9, 2010

(54) CEILING MICROPHONE ASSEMBLY

(75) Inventors: Jeffrey Rodman, San Francisco, CA (US); Peter Chu, Lexington, MA (US); Alain Nimri, Austin, TX (US); Stephen Schaefer, Cedar Park, TX (US); Martin G. Sexton, Round Rock, TX (US)

(73) Assignee: Polycom, Inc., Pleasanton, CA (US)

( * ) Notice: Subject to any disclaimer, the term of this patent is extended or adjusted under 35 U.S.C. 154(b) by 752 days.

(21) Appl. No.: 11/156,954

(22) Filed: Jun. 20, 2005

(65) Prior Publication Data

US 2006/0088173 A1 Apr. 27, 2006

Related U.S. Application Data

(60) Provisional application No. 60/621,743, filed on Oct. 25, 2004.

(51) Int. Cl.
*H04R 9/08* (2006.01)

(52) U.S. Cl. ..... 381/355; 381/356

(58) Field of Classification Search ..... 381/91, 381/92, 122, 355
See application file for complete search history.

(56) References Cited

U.S. PATENT DOCUMENTS 4,237,339 A 12/1980 Bunting et al. ..... 179/1 CN
5,323,257 A * 6/1994 Abe et al. ..... 398/129
5,675,660 A * 10/1997 Townsend ..... 381/361
5,991,385 A * 11/1999 Dunn et al. ..... 379/202.01
2001/0012374 A1* 8/2001 Rodemer ..... 381/369
2003/0160862 A1* 8/2003 Charlier et al. ..... 348/14.08
2004/0037437 A1* 2/2004 Symons et al. ..... 381/92

FOREIGN PATENT DOCUMENTS

DE 968805 4/1958

OTHER PUBLICATIONS

European Search Report dated Nov. 13, 2007.
"Polycom® Ceiling Microphone Array—Extraordinary room coverage with superior audio pickup;" 2 Page Brochure; © 2005 Polycom, Inc.
"SCM-2 Implant Microphone;" Sound Control Technologies; 2 Page Brochure; © 2000 Sound Control Technologies, Inc.
"PZM®-11LL—Pressure Zone Microphone®;" 2 Page Brochure; © 2002 Crown Audio, Inc.
"CM-01—Ceiling Microphone;" 2 Page Brochure; Conference Technology Group.

* cited by examiner

*Primary Examiner*—Brian Ensey
*Assistant Examiner*—Sunita Joshi

(57) ABSTRACT

An overhead microphone assembly using multiple unidirectional microphone elements. The microphone assembly is installed overhead, generally above all the desired sound sources and below the undesired sound sources. The signals from these multiple microphone elements are fed into a microphone steering processor which can mix and gate the signals to ensure the best signal/noise ratio. The steering processor may also track the sound source dynamically when such tracking (source locating) is desired. The resulting audio signal from the steering processor may be further processed, such as echo canceling, noise reduction and automatic gain control.

21 Claims, 10 Drawing Sheets

| | 102 Omni-directional | 104 Dipole Microphone | 106 Cardioid Microphone | 108 Hyper-Cardioid |
|---|---|---|---|---|
| Polar Response |  |  |  |  |
| Polar Equation | *1* | *Cos (θ)* | *0.5*cos (θ) +0.5* | *0.75*cos(θ)+0.25* |
| Directivity Index | *0 dB* | *4.8dB* | *4.8dB* | *6.0dB* |
| Distance Factor | *1* | *1.7* | *1.7* | *2* |
| Relative Output at 180 degree | *0 dB* | *0 dB* | *-∝* | *-6dB* |

CEILING MICROPHONE ASSEMBLY

RELATED APPLICATIONS

This application claims priority from U.S. provisional patent application, No. 60/621,743, filed on Oct. 25, 2004 with the same title and assigned to the same assignee, which is incorporated herein by reference.

BACKGROUND OF THE INVENTION

1. Field of the Invention

This invention relates generally to microphone assembly in a system which needs to convert sound waves to electrical signals.

2. Description of the Related Art

A microphone is a basic and essential element in any audio systems. There are many types of microphones in use currently. Generally, they are classified in four categories as listed in FIG. 1. The first one is an omni-directional microphone 102. It has a uniform polar response, i.e., the sound waves from any directions can be accepted and an electrical signal is generated with the same gain. A second type of microphone, a dipole microphone 104, can respond to sound waves mainly from two opposite directions. Sound waves coming from other direction have a much smaller gain. The sound wave coming from a direction that is 90° to the axis of the microphone element is not accepted, i.e. the gain is null. A third type of microphone is a cardioid microphone 106, which can accept sound waves from one primary direction. The response gain decreases as the incident angle of a sound wave deviates from the primary direction. The response gain drop can be substantial when the incident angle is greater than a microphone is a hyper-cardioid microphone 108. Hyper cardioid microphone 108 is like a hybrid of a dipole microphone and a cardioid microphone. It has a primary direction and a secondary direction, which is the opposite of the primary direction. It can respond to sound waves in both the primary and the secondary directions, but its gain for the secondary direction is less than the gain for the primary direction.

An array of microphones may also be assembled to emulate the properties of the above four types of microphones in some applications. For example, non-directional microphones may be grouped together. A controller may process the signals in such a way so as to generate a signal that is highly directional, so this array of microphones acts as if it is a directional microphone. Another example is discussed in U.S. Pat. No. 5,715,319, where several directional microphones are arranged in a circular array. The resulting microphone array acts similarly to a non-directional or omni-directional microphone. In this application, a microphone element can refer to a generic single element microphone, or a multiple-element-array, which behaves similar to a single element microphone. For example, a unidirectional microphone can be a single cardioid microphone, or a microphone array that accepts sound waves from a primary direction and rejects sound waves from most other directions. The microphone elements within the microphone array may be non-directional, bi-polar or hyper-cardioid or some combination.

Any one of the four types of microphones identified above has various disadvantages in audio systems, especially in audio conferencing and video conferencing applications. For example, an omni-direction microphone, which gathers sound from all directions equally, can be used in recording studios where the noise and reverberation level can be made to low, but gives poor quality in audio or video conferencing applications, because of its inability to reject reverberation and noise in a typical untreated room environment. A cardioid microphone only accepts sound waves directed towards the microphone and rejects most sound waves coming from other directions. This type of microphone may provide a higher signal to noise ratio (SNR) and a better sound quality, but it can only cover a very small area in the conference room. Participants in an audio or video conference may have to take turns speaking to the microphone. In some conference room setups, several such microphones can be connected to the system simultaneously, so most participants of the conference have a microphone nearby available to speak into. But this type of arrangement complicates the conference room and makes the room cluttered.

Although it is generally accepted that one may have to hold a microphone while giving a lecture in a large auditorium, it is still unnatural and inconvenient. In a conference situation, it is even worse. In an actual meeting, meeting participants would like to watch people's expressions on their face and other body language as they speak.

There are prior art devices that avoid many of the limitations of the microphone elements. For example, a Polycom SoundStation VTX-1000 speakerphone from the assignee of the current invention uses three microphone elements to provide better room coverage, SNR and frequency response. This speakerphone fulfills many requirements in a conference setting such that it appears on most conference room tables.

It is more desirable to eliminate the inconvenient microphones, or at least to keep them out of sight during a conversation and minimize their interference. It is desirable to have a microphone system that can provide coverage of the entire conference room, while at the same time keeping the sound quality high and maximizing the signal to noise ratio. It is desirable to have a microphone system that can provide other high quality sound processing.

SUMMARY OF THE INVENTION

The current invention uses multiple unidirectional microphone elements in a microphone assembly. The microphone assembly is installed overhead, generally above all the desired sound sources. The signals from these multiple microphone elements are fed into a microphone steering processor which mixes and gates the signals to ensure the best signal/noise ratio. The steering processor may also track the sound source dynamically when such tracking (source locating) is desired. The resulting audio signal from the steering processor may be further processed, such as echo canceling, noise reduction and automatic gain control. The microphones of the current invention can cover a large conference room. They are also scalable, that is, when the conference room grows, capacities of the microphones can grow accordingly by adding more microphones.

BRIEF DESCRIPTION OF THE DRAWINGS

A better understanding of the invention can be obtained when the following detailed description of the preferred embodiment is considered in conjunction with the following drawings, in which.

DESCRIPTION OF THE PREFERRED EMBODIMENT

Figure 1:
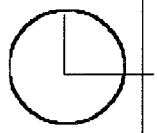
FIG. 1 illustrates four types of microphone elements and their characteristics.
Figure 1:
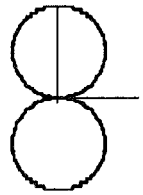
Figure 1:
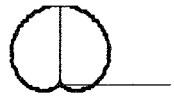
Figure 1:
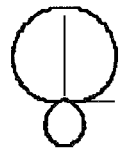
Figure 2:
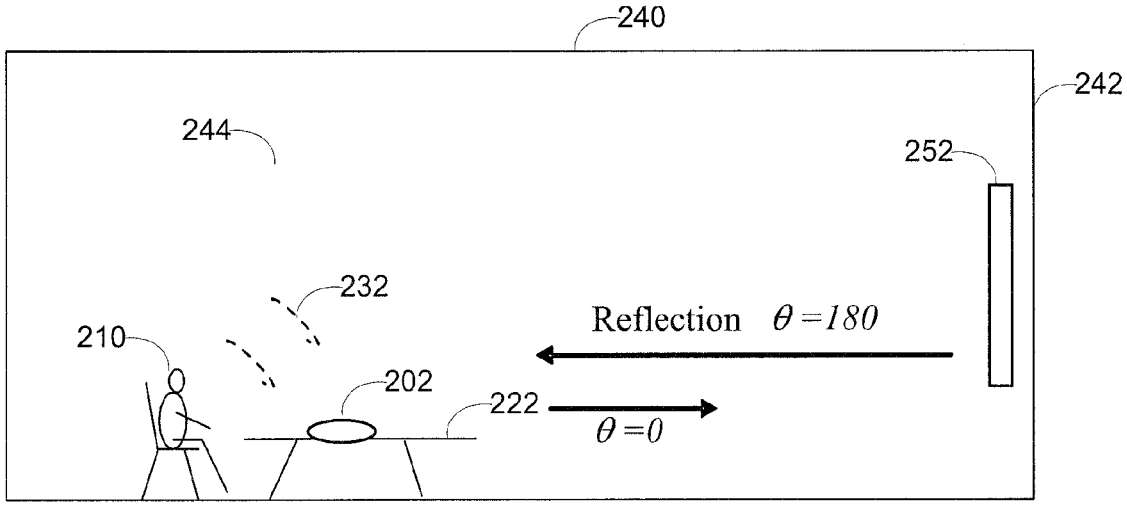
FIG. 2 illustrates a conference-room set up.

FIG. 2 shows a typical conference room arrangement 244. A conference participant 210 sits at a conference table 222, facing a video monitor 252 at a side wall 242. A microphone 202 (or several microphone elements in a speakerphone such as a Polycom SoundStation VTX-1000 speakerphone) may be placed on the conference table 222. Speech 232 may propagate within the conference room and may be reflected by walls, e.g. 242, and ceiling 240. The reflected sound waves, which may also be referred to as room reverberation, are typically undesired and should be rejected by the microphone if possible. It can be done when a cardioid microphone is used. The cardioid microphone only accepts sound waves in one direction. The reflected sound waves, which are in the opposite direction, are rejected. This way, the cardioid microphone can reject the unwanted first-stage reverberations from the room, leading to an improvement of the direct to reverb ratio.

Figure 3A:
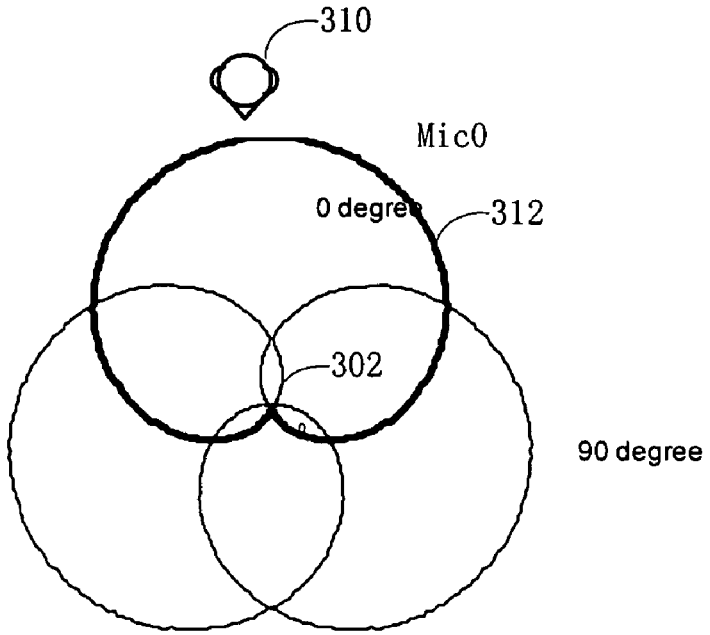
FIG. 3 illustrates one embodiment of the current invention wherein three unidirectional microphone elements are used in a microphone and steered.
Figure 3B:
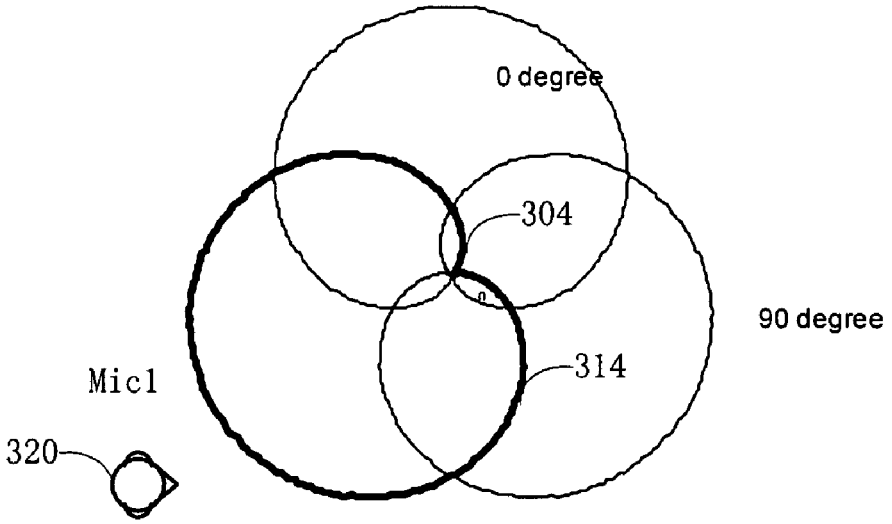
Figure 3C:
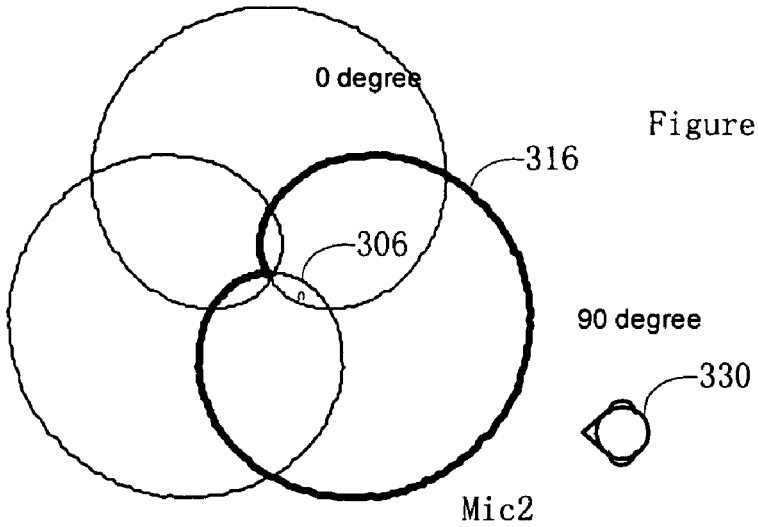
Figure 9:
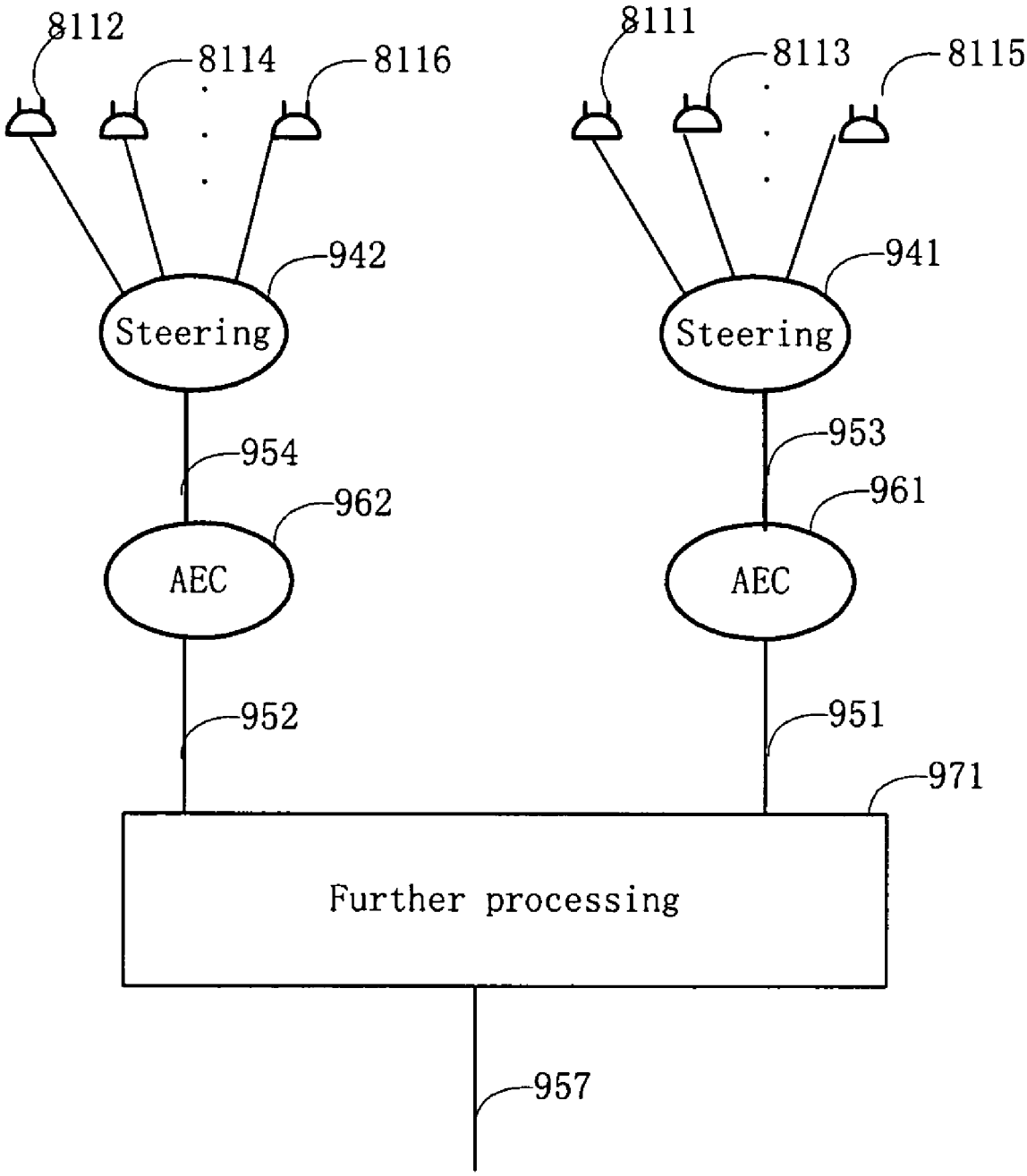
FIG. 9 is a block diagram showing the signal processing for a microphone.

Since a single cardioid microphone element can only accept sound waves in a small area along the direction of its primary direction, according to an embodiment of the current invention, several microphone elements are implemented in a microphone so that the microphone can accept sound from many directions when necessary. In FIGS. 3*a*-3*c*, the sound response coverage of a microphone with three cardioid microphone elements is shown. The cardioid microphone elements are connected to a mic-steering controller (e.g. as shown in FIG. 9), which controls and processes the signals generated by the cardioid microphone elements. In this embodiment, there are three elements 302, 304 and 306, each spaced 120 degrees apart. The corresponding response coverage is shown in FIGS. 3*a*-3*c*. The mic-steering controller chooses the best microphone element by detecting the best audio qualities among the three elements. As shown in FIGS. 3*a*-3*c*, when a human talker speaks, the nearest element is typically selected to provide the best quality audio signal. In FIG. 3*a*, when the participant 310 speaks, the microphone element 302 is activated, which has a response 312. The other microphone elements 304 and 306 are disabled, or ignored by the mic-steering controller. Similarly, when participant 320 speaks, only microphone element 304 is activated to provide a response 314. When participant 330 speaks, only microphone element 306 is activated to provide a response 316. In FIG. 3*a*-3*c*, the talkers 310, 320 and 330 are shown as three different persons, but they can be a single person, moving to three different locations within the conference room, or some combinations in between.

When more than one participant speaks, then more than one microphone element may be chosen. The mic-steering controller is designed to intelligently differentiate between the human speech and other noises, such as air conditioning noise, so that it is not "fooled" by noises. This ensures that the best audio quality is always retained when a talker (or instructor in long distance education applications) walks around in a room equipped with air conditioning. The tracking speed of the controller is virtually instantaneous since no mechanical moving part is involved. The mic-steering controller simply determines which microphone element is selected, and whose signal is further processed by the controller or other down stream processors, if any. The mic-steering controller may also perform gating and mixing to combine the signals from more than one microphone element to form an output microphone signal.

Figure 4:
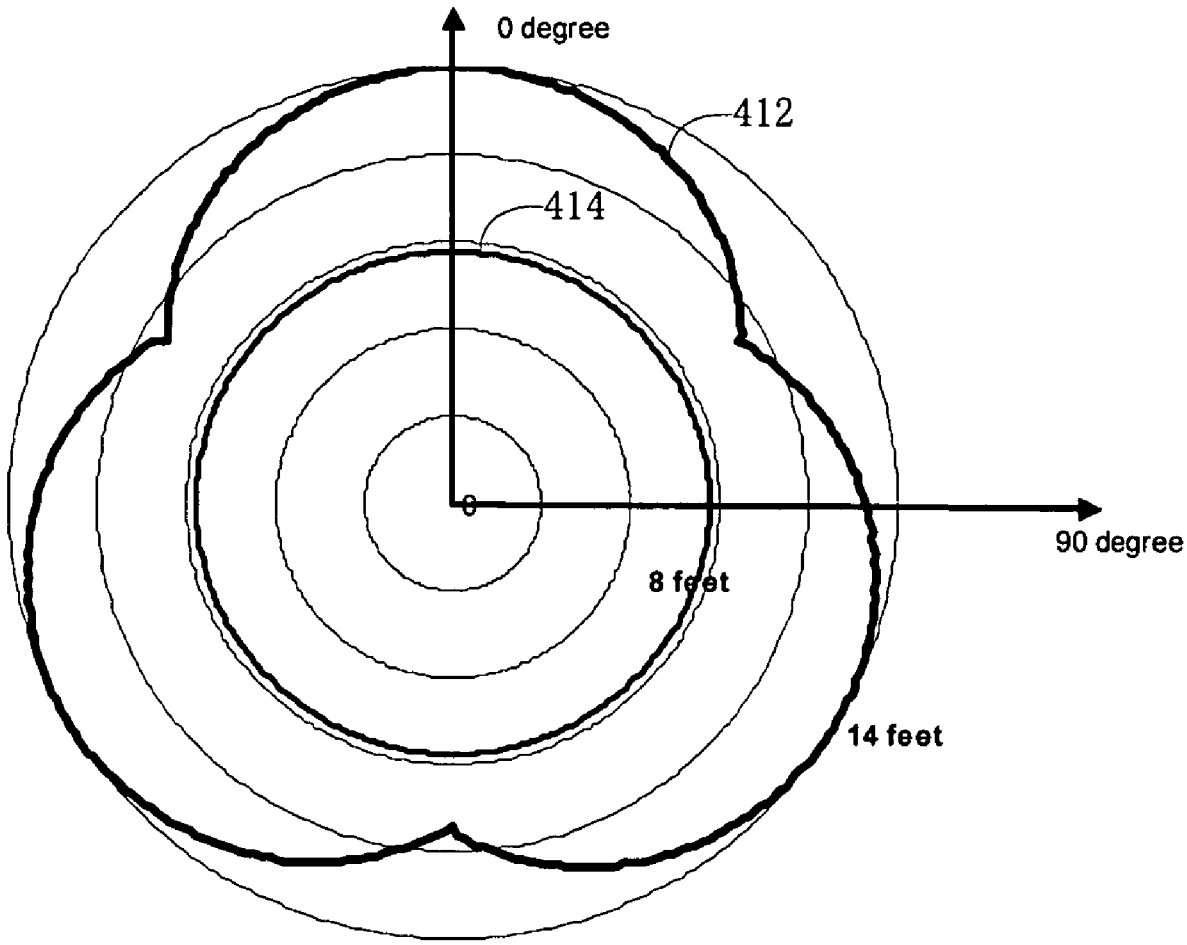
FIG. 4 compares the responses of a microphone according to one embodiment of the current invention and a typical omni-directional microphone available on the market.

The microphone according to the above embodiment is shown to be much better than the existing commercial microphones. FIG. 4 shows the equal audio-quality contours. A commercially available omni-directional microphone is used as a reference. The distance for the omni-directional to generate a fairly good audio is about 8 feet, as shown by contour 414. The same quality contour 412 for the above embodiment of the current invention is also shown. The contour 412 is almost 14 feet away from the microphone and covering about 600 square feet in area.

Figure 5:
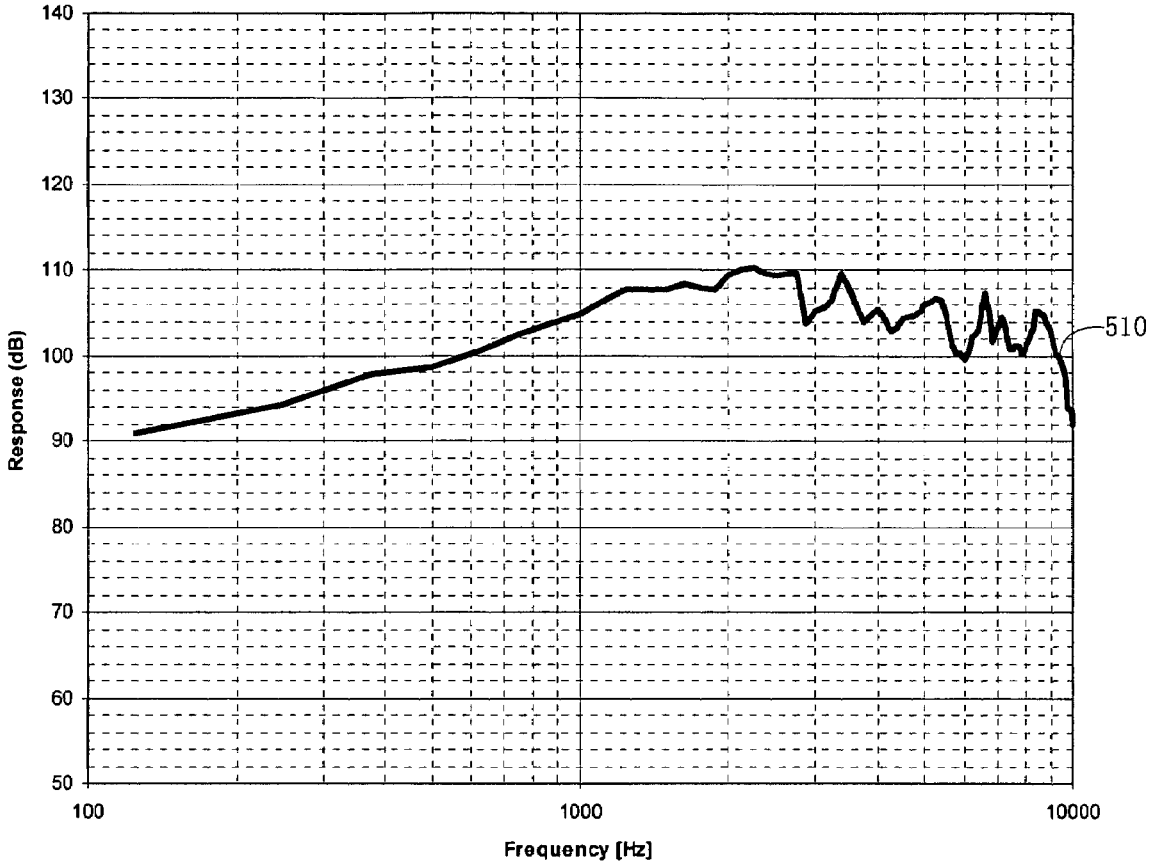
FIG. 5 shows the frequency response of a microphone according to one embodiment of the current invention.
Figure 6:
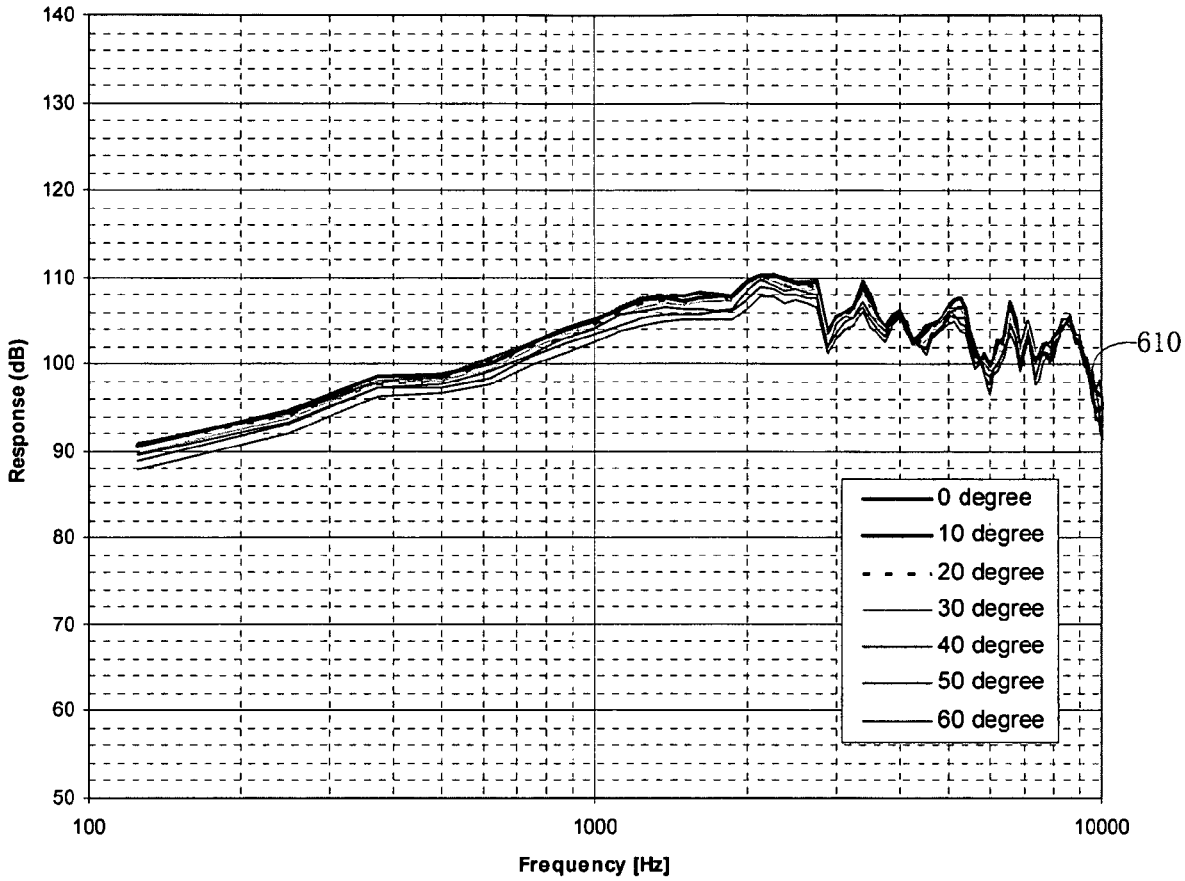
FIGS. 6 and 7 compare the angular and frequency responses of a microphone according to one embodiment of the current invention.
Figure 7:
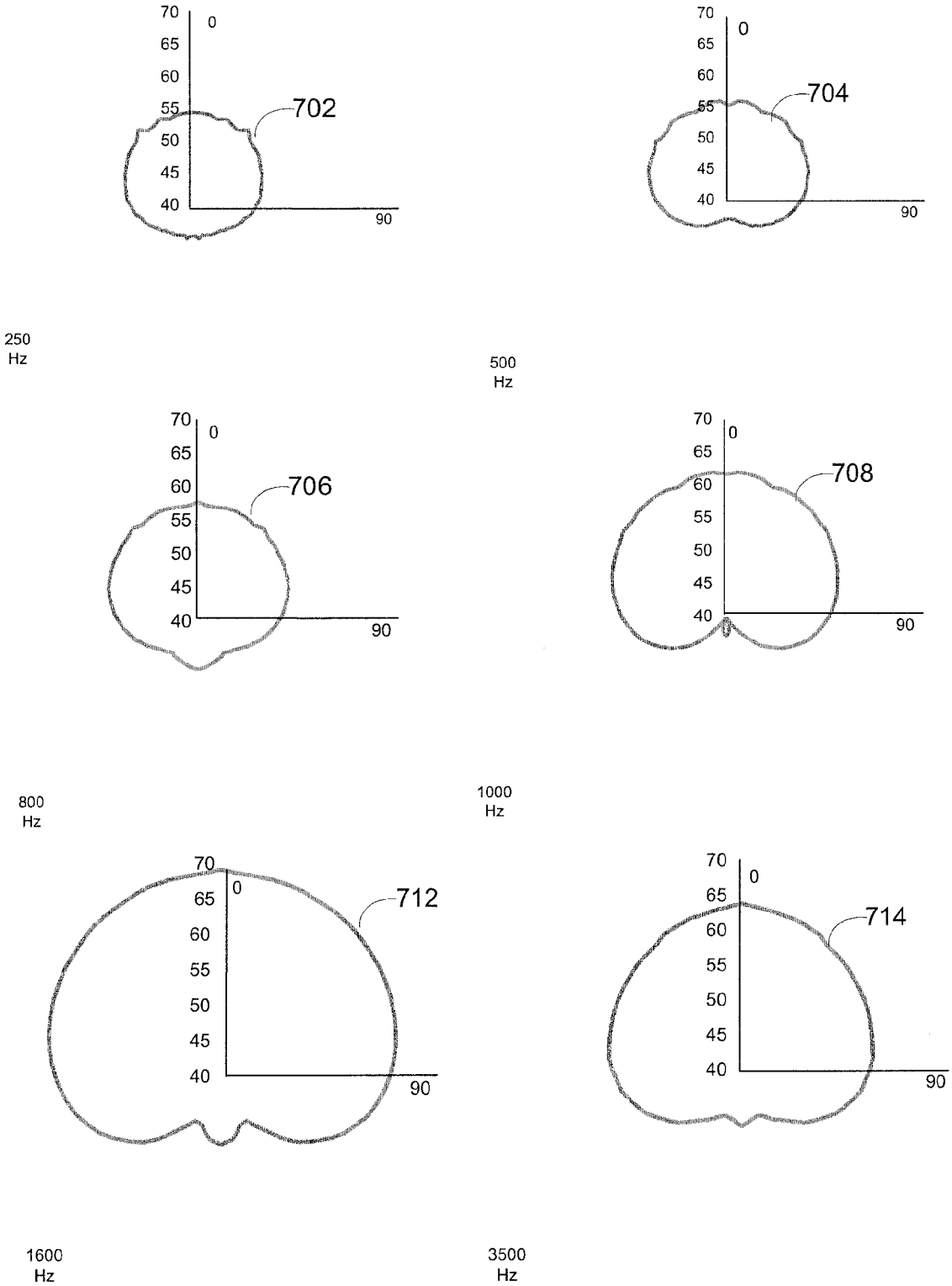

FIGS. 5-7 shows more properties of the microphone of the above embodiment. FIG. 5 shows a frequency response curve 510 at the direction of a microphone element. FIG. 6 further shows the frequency response for different angles of incidence. Since the microphone has three identical cardioid elements placed 120 degrees apart and that the cardioid elements are symmetric, it is only necessary to exam the performance of one element at 0 degree to +60 degree. The performance curves at −60 degree to 0 degree are symmetrical to those at 0 degree to +60 degree. As shown in FIG. 6, the frequency responses for all incident degrees, ranging from 0 degree to 60 degree are almost overlapping with each other, indicating very uniform angular responses. This implies that the audio tonality remains the same wherever a talker walks in a room around the microphone. Due to the uniform responses across the different angles of incidence, even though the frequency responses are not flat, they can be flattened by a single frequency equalizer.

FIG. 7 shows more detail polar responses for various frequencies, ranging from 250 Hz to 3500 Hz. The plots (702-714) indicate the wide-angle sound pickup while the average front-back rejection remains very good, 20 dB at 1000 Hz and 15 dB at 3500 Hz.

In the above embodiment, three cardioid microphone elements are included in one microphone. More or less number of elements may be implemented based on the property of the microphone element and the need of a particular application. In particular, when the conference room or lecture hall is greater than the 600 square feet coverage provided by a single microphone as discussed above, more microphones can be installed in cooperation with each other under the control of a mic-steering controller. In one embodiment, three microphones are installed in a lecture hall. The total coverage is 1800 square feet, which is a huge conference room that can seat about 150 people comfortably. Depending on the need, other arrangements are possible.

Figure 8A:
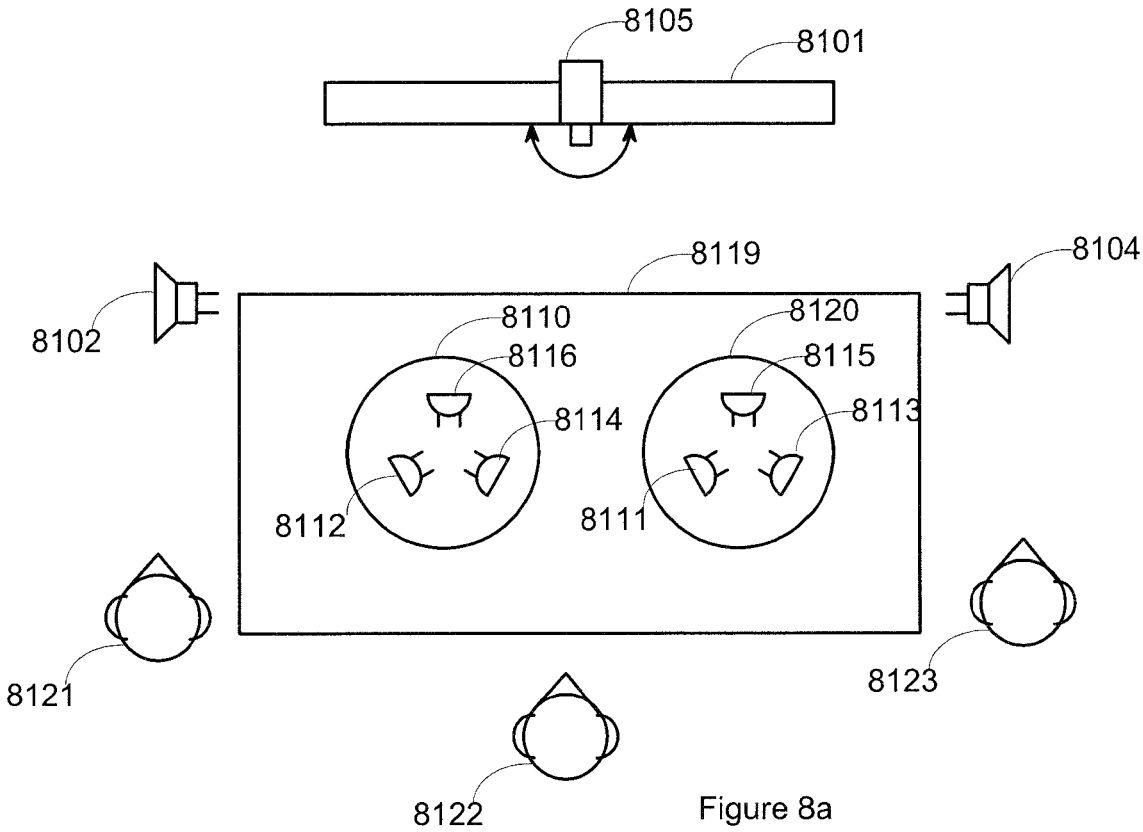
FIGS. 8*a* and 8*b* illustrate a setup in a conference room according to an embodiment of the current invention.
Figure 8B:
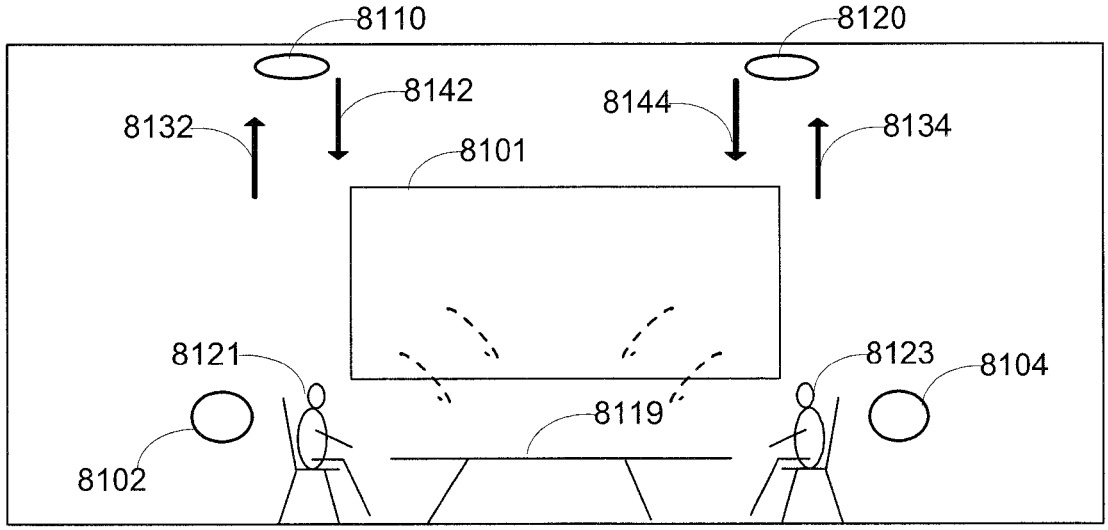

FIGS. 8*a* and 8*b* show a typical conference room arrangement according to one embodiment of the current invention using two microphones as discussed above. FIG. 8*a* is a top view and FIG. 8*b* is a side view. The conference room is equipped with a video monitor 8101 and a video camera 8105 at one end of the conference room. The conference table 8119 is placed in the middle of the conference room. The microphones 8110 and 8120 are overhead microphones. They are maintained in place above the conference participants. In this conference room, there are no other objects in between the overhead microphones and the conference participants. The microphone elements in an overhead microphone can receive sound waves from the conference participants directly. In one embodiment, the overhead microphones are hung from the ceiling and above all conference participants. This way, there are no microphones and associated wires or other components lying around the conference table interfering with the conference participants. More details about the assembly are discussed below in reference to FIGS. 10*a-g*. In this embodiment, each microphone 8110 or 8120 has three cardioid microphone elements 8111-8116. Conference participants, such as 8121, 8122 and 8123, can sit anywhere within the conference room. Their voices can be picked up by any one of the six microphone elements 8111-8116. Since the microphones are place overhead, i.e. above all participants, sometimes near the ceiling, only direct speech sounds 8132 and 8134 are accepted by the microphones 8110 and 8120. The first stage reflected sounds, or room reverberation 8142 or 8144 are rejected by the microphones 8110 and 8120. Loudspeakers 8102 and 8104 are installed to reproduce speech sound from far end sites of the conference. Echoes or feedbacks between the microphones and loudspeakers are eliminated by audio signal processing. There are many available methods for audio echo cancellation and feedback elimination. Any one of them may be used in this embodiment of the current invention.

The implementation of overhead microphone arrays removes microphones from a conference table in a conference setting. Comparing to typical table-top microphones or speakerphones having embedded microphones, an overhead microphone array is "out of sight" from conference participants and does not interfere with the conference participants. At the same time, the overhead microphone is acoustically more "in sight" than any desk top microphones. When there are more than a few people in a conference, most people behind the first row do not have a direct line-of-sight to the table top microphone. Speech from these people behind the first row is not very well received by the microphone due to the interference of people or objects in between. On the other hand, an overhead microphone is implemented above all conference participants, regardless how many they are. As long as the microphone is maintained overhead, its height is only a design choice, mostly aesthetic choice. It could be on the ceiling, below but close to the ceiling, or only slightly above people when they are seated. Typically, the top half of a room, i.e. the space from the middle between the floor and the ceiling of a room to the ceiling of the room, is considered overhead space of the room. In most conference rooms, there is nothing in between the overhead microphone and a talker below in the room. The overhead microphone can always receive direct sound waves from any talkers in the room so that the microphone signal generated has the best acoustic quality.

In the embodiment shown in FIGS. 8*a* and 8*b*, two microphones 8110 and 8120 may be used for two separate audio channels. These two independent audio channels may form a stereo audio field. They can be transmitted independently to other sites of the conference. Similarly, if other sites are also equipped with multiple audio channels and are received by the local site, they can be formed into space differentiating stereo audio field. The space differentiating stereo audio field can be combined with the video display to simulate more life-like conference experience.

FIG. 9 illustrates a block diagram for signal processing for the embodiment shown in FIGS. 8*a* and 8*b*. The microphone elements 8111-8116 are grouped in two microphones: elements 8112, 8114 and 8116 are for microphone 8110 as shown in FIG. 8*a*; elements 8111, 8113 and 8115 are for microphone 8120. The signals from microphone elements are fed into two steering controllers 942 and 941 respectively. The steering controller 942 and 941 operates independently to form two separate audio channels. The operation of the steering controller 941 or 942 is the same, i.e. to detect, select and mix the best signal quality from the elements in the connected microphone. When one element is identified as the best source of signal, then only that signal is passed as signal 954 to downstream processing components. The signals from other elements may be discarded. If more than one element is selected, then a mixing takes place in the steering controller to form signal 954. A similar process takes place to form signal 953 out of steering controller 941. Audio signal 954 or 953 is typically fed into a signal processor, such as an acoustic echo canceller 962 or 961 to remove the echoing signal due to the loudspeakers in the conference room. The substantially echo free signals 952 and 951 are then fed into a processor 971 for further processing if necessary. For example, the audio signals may be frequency equalized to correct the non-flat frequency responses as shown in FIGS. 5-7; the noise in the audio signals may be reduced to improve intelligibility or white noise be added to compensate echo cancellation or noise reduction; signal strength may also be adjusted to compensate the different gains in the microphone. The audio signals may also be encoded for transmission in a network system, such as Internet, Integrated Services Digital Network (ISDN) or Plain Old Telephone Service (POTS). The conditioned signal 957 is transmitted to other sites in the conference. For clarity, the steering, echo cancellation and other processing are shown to be performed by different processors. In an actual embodiment, these functions are likely performed by a single processor. They may also be divided and performed by two or more processors with a different distribution of tasks.

Figure 10A:
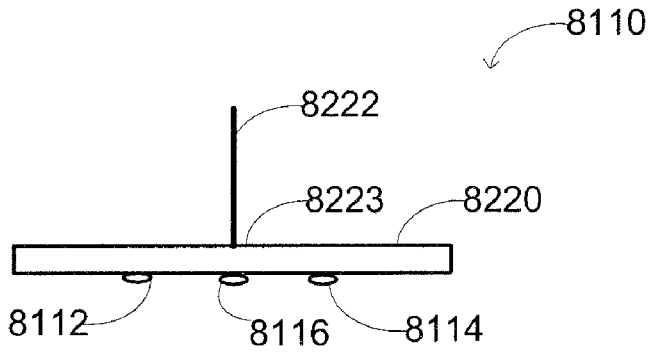
FIGS. 10*a*, 10*b*, 10*c*, 10*e*, 10*f* and 10*g* illustrate some physical arrangements of a ceiling microphone according to embodiments of the current invention.
Figure 10B:
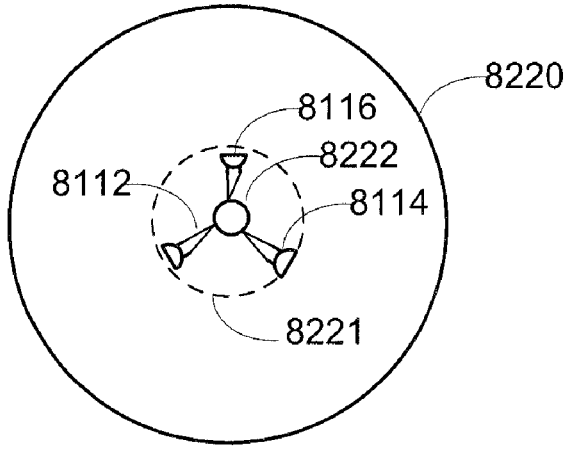

FIGS. 10*a-g* illustrate more details of the overhead microphones used in the conference systems shown in FIG. 8. FIG. 10*a* is a side view and FIG. 10*b* is a top view. In this embodiment shown in FIG. 10*a*, there is a supporting structure 8223 including a pole 8222 and others. The supporting structure 8223 secures the microphone 8110 to the ceiling of a conference room. The lower end of the pole 8222 holds the body of the microphone 8110. The microphone 8110 has three microphone elements 8112, 8116 and 8114. Each element is a cardioid microphone element. Each has a 120-degree angular responsive range. They are arranged 120-degree apart to each other. This way, the microphone 8110 can accept sound from 360-degree around. If the microphone elements used in a microphone have different angular responsive range, then the number of microphone elements used would be different. Each element in the microphone is coupled to a mic-steering controller (not shown). The connection between microphone elements and the controller can be of many different ways. It is possible that the processor is located at a different location and is connected to the elements via a simple wired connection. The wires from the microphone elements go through the center of the supporting pole 8222, through the space above the ceiling to a controller located in another part of the conference room.

Figure 10C:
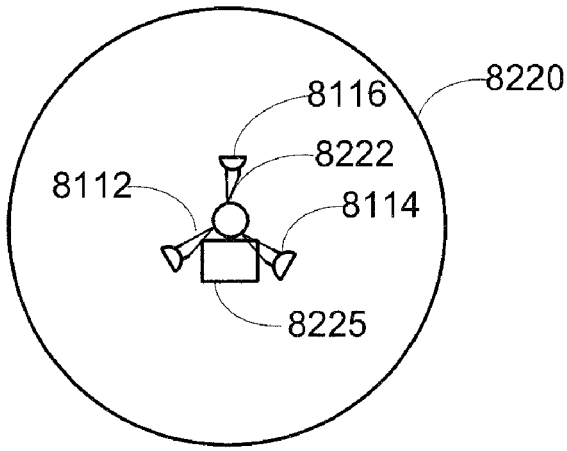

It is more desirable in some situations to put a processor onboard the microphone so that only processed microphone signals are sent to an audio system. FIG. 10*c* shows a processor 8225 within the microphone 8110. This way, less amount of information needs to be communicated between the microphone elements and the controller. The processor may also perform other signal processing tasks, especially the tasks related only to the microphone itself, such as automatic gain control, frequency response equalization and noise reduction. Since the microphone elements and an on-board signal processor are low power consumption components, they may be powered by small batteries for extended period of time. With an additional radio transceiver, which may also be a low power consumption component, the microphone can be made into a wireless microphone, requires no wired connection with external systems. This way, the microphone is very flexible and can be added or removed from any location easily. The transceiver in the microphone can transmitted its signals to an audio system which is capable of communicating with wireless microphones.

In another embodiment, the microphone 8110 may also include a back shield 8220 that is located immediately above the microphone elements. This way, any sound waves from above back shield 8220 are blocked by back shield 8220. The noise from above, such as noises due to air conditioner vents, florescent lighting etc., is blocked from reaching the microphone elements. Since most background noise in a conference room is the noise from sources overhead, this arrangement of microphone elements with a back shield may reduce the need of noise reduction processing. Another benefit of the back shield 8220 is that it can help boost the microphone sensitivity gain if a talker is right underneath the microphone 8110. The sound pressure is doubled due to the boundary effect of the back shield. This effect is used to the advantage because some sound energy is lost if a talker is seated right underneath the microphone 8110 due to the diffraction of the talker's head, and due to the cardioid directivity. The doubled sound pressure helps compensate the energy loss and equalize the microphone element response. Due to the reduced acoustic noise and increased acoustic signal, the signal processing requirement, especially the noise reduction requirement, is reduced.

The size of the back shield can vary. To provide maximum benefit of shielding, it is desirable to make the back shield as large as possible, much larger compared to each microphone element. When the microphone elements are arranged in a circle, the radius of the back shield 8220 is typically at least twice as large as the radius of that circle 8121 as shown in FIG. 10*b*. The back shield may be made of any sound reflecting or sound absorptive materials. In one embodiment, a clear round plastic plate having a diameter of 27 inches is used as a shield. The diameter of a typical shield is about 12 inches to 30 inches.

Figure 10D:
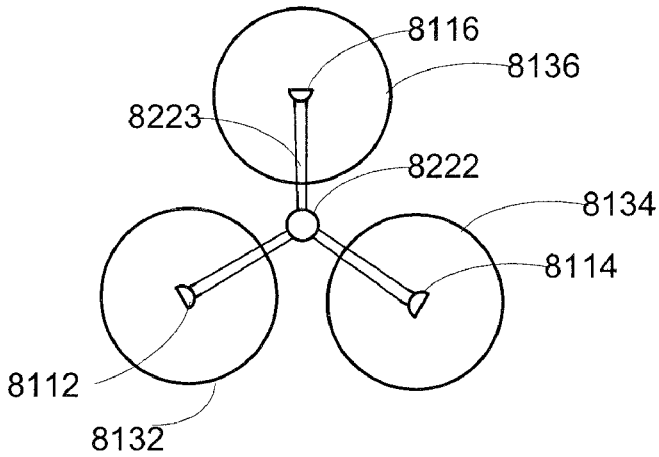
Figure 10E:
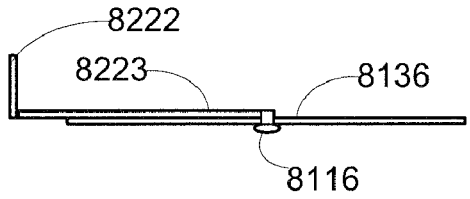

The back shield may also be installed on each individual microphone element, rather than one shield for all elements. One example is shown in FIGS. 10*d* and 10*e*. A back shield for each individual microphone element can be smaller. For example the individual shield 8132, 8134 and 8136 for microphone element 8112, 8114 and 8116 respectively is smaller than shield 8220. An individual shield may also be better oriented to provide better blocking of unwanted noise.

Figure 10F:
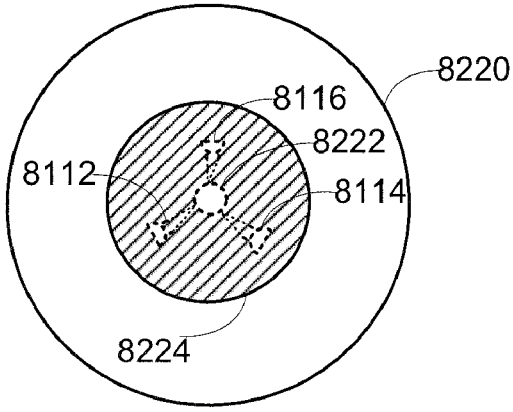
Figure 10G:
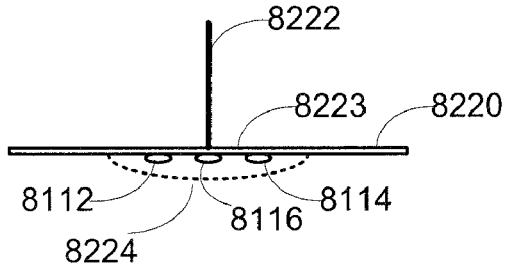

Each microphone element may be placed individually, or they may be enclosed together in the same housing as shown in FIGS. 10*f* and 10*g*. The bottom of the housing 8224 is sound permeable (as indicated by a broken line) to allow sound waves from below, e.g. speech from conference participants, to reach the microphone elements. The top (and the sides of the housing, if any) is solid (as indicated by a solid line) such that they are sound impermeable. Sound waves from directions other than below cannot reach the microphone elements inside the housing. The housing 8224 itself can provide some shielding and reflecting effects. To provide better shielding, a back shield 8220 is attached immediately above the microphone housing 8224.

The overhead microphone assembly can be installed in a conference room and used in a conference system. It can also be used in many other applications, such as a video conference or just a meeting in that room. An audio system can amplify a participant's speech so every one in the room can hear the speech. Once a speech is captured by an overhead microphone assembly, the speech signal may be utilized in any ways, such as being amplified and reproduced at the same location, transmitted to a far end site, broadcasted through a radio or recorded in a permanent media for future reproduction.

The overhead microphone assembly as shown in FIGS. 10*a* and 10*b* is secured in place by a hollow rod attached to the ceiling of the conference room. It can also be secured in place overhead by any other methods. For example, the microphone may be attached to the bottom of a hanging light fixture or a decorative object. It may also be attached to a supporting arm extended from a side wall. To reduce vibration noise from mechanical equipment in the building, vibration absorbing isolators may also be inserted between the microphone and its supporting structure or the ceiling.

Ceiling mounted microphones have been used in many prior art applications. Most of them are used for security and surveillance purposes. In those applications, it is more concerned about the invisibility of the microphones, e.g. visible size of the microphone, rather than the fidelity of the acoustics. They typically use pressure zone microphones, a type of omni-directional microphone element. Some prior art ceiling mounted microphones are used in conference room, but the sound quality is less than desirable. As discussed earlier, omni-directional microphone elements typically do not provide good quality audio signals in a conference room setting, especially when there are more than a couple of people participating in the conference.

The current invention utilizes overhead microphones that have multiple microphone elements. The microphones according to the embodiments of the current invention can greatly improve the sound quality, increase the area coverage, reduce acoustic noise level received by the microphone and reduce the microphone interference with conference participants. It greatly improves the liveliness of a teleconference.

Although the examples discussed above are using the overhead microphones in conference rooms, overhead microphones may be used in many other locations where high quality microphones are desired. Such locations include, but not limited to, class rooms, auditoriums and performing art theaters etc.

While illustrative embodiments of the invention have been illustrated and described, it will be appreciated that various changes can be made therein without departing from the spirit and scope of the invention.

The invention claimed is:

1. A microphone assembly in a room, wherein the room has a ceiling and a floor to accommodate people, and wherein the room has overhead space between any people and the ceiling, the microphone assembly comprising:

a support member;

a plurality of unidirectional microphone elements attached to the support member, wherein all microphone elements are maintained in the overhead space by the support member, and a signal processor module coupled to the microphone elements, wherein the processor module is programmed to provide an output based only on the microphone element providing the best audio quality for a first human speaker.

2. The microphone assembly of claim 1, wherein:

the signal processor module is attached to the support member.

3. The microphone assembly of claim 1, wherein the unidirectional microphone elements are cardioid microphone elements.

4. The microphone assembly of claim 1, wherein the unidirectional microphone elements are microphone arrays, each of which accepts sound waves in a primary direction.

5. The microphone assembly of claim 1, wherein the support member is attached to the ceiling of the room.

6. The microphone assembly of claim 1, further comprising a shield attached to the support member immediately above all microphone elements.

7. The microphone assembly of claim 1, further comprising a shield attached to each microphone elements, wherein the shield is immediately above the microphone element.

8. The microphone assembly of claim 1, further comprising a housing attached to the support member, wherein the housing contains the microphone elements and the processor module, wherein the housing has a top and a bottom, wherein the top is not sound permeable and the bottom is sound permeable.

9. The microphone assembly of claim 8, wherein the housing further has a shield immediately above the housing.

10. The microphone assembly of claim 1, wherein the signal processor is further operable to balance frequency response, adjust control microphone gain and reduce noises.

11. The microphone assembly of claim 1, wherein microphone assembly is coupled to an audio system, the microphone assembly further comprising, a transceiver coupled to the signal processor, wherein the transceiver is operable to communicate with the audio system; and a battery coupled to the signal processor.

12. An audio system, wherein a portion of the audio system is in a room, wherein the room has a ceiling and a floor to accommodate people, and wherein the room has overhead space between the people and the ceiling, the audio system comprising:

an overhead microphone assembly in the room, wherein the overhead microphone assembly includes, a support member; and a plurality of unidirectional microphone elements attached to the support member, wherein all microphone elements are maintained in the overhead space by the support member;

an amplifier;

a loudspeaker coupled to the amplifier; and a signal processor coupled to all microphone elements and the amplifier, wherein the processor module is operable to provide an output based only on the microphone element providing the best audio quality for a first human speaker to the amplifier.

13. The audio system of claim 12, wherein the unidirectional microphone elements are cardioid microphone elements.

14. The audio system of claim 12, wherein the unidirectional microphone elements are directional microphone arrays, each of which accepts sound waves from a primary direction.

15. The audio system of claim 12, wherein the support member is attached to the ceiling of the room.

16. The audio system of claim 12, further comprising a shield attached to the support member immediately above all microphone elements.

17. The audio system of claim 12, further comprising a shield attached to each microphone elements, wherein the shield is immediately above the microphone element.

18. The audio system of claim 12, further comprising a housing attached to the support member, wherein the housing contains the microphone elements and the processor module, wherein the housing has a top and a bottom, wherein the top is not sound permeable and the bottom is sound permeable.

19. The audio system of claim 18, wherein the housing further has a shield immediately above the housing.

20. The audio system of claim 12, wherein the signal processor module is operable to further process the audio signal including noise reduction, echo cancellation, frequency balancing and automatic gain control.

21. The audio system of claim 12, further comprising, a transceiver coupled to the signal processor;

wherein the overhead microphone assembly further includes, a microphone transceiver coupled to the microphone elements;

a microphone signal processor couple to the microphone transceiver and the microphone elements; and a battery coupled to the microphone signal processor;

wherein the transceiver is in communication with the microphone transceiver; and wherein the signal processor is coupled to the microphone elements through the transceiver and the microphone transceiver.

* * * * *

UNITED STATES PATENT AND TRADEMARK OFFICE

CERTIFICATE OF CORRECTION

PATENT NO. : 7,660,428 B2
APPLICATION NO. : 11/156954
DATED : February 9, 2010
INVENTOR(S) : Rodman et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1239 days.

Signed and Sealed this

Thirtieth Day of November, 2010

David J. Kappos

David J. Kappos
*Director of the United States Patent and Trademark Office*